US006505641B1

(12) United States Patent
Gebert et al.

(10) Patent No.: US 6,505,641 B1
(45) Date of Patent: Jan. 14, 2003

(54) DEVICE FOR AN ARRANGEMENT INSIDE A FUEL TANK FOR SUPPLYING AND FILTERING FUEL

(75) Inventors: Hans Gebert, Heilbronn (DE); Horst Schneider, Waiblingen (DE); Jim Siekmann, Arnold, MO (US); Hans Waibel, Remseck/Aldingen (DE); Rüdiger Walter, Bonn (DE)

(73) Assignees: Mahle Filtersysteme GmbH, Stuttgart (DE); Kautex Textron GmbH & Co. KG, Bonn (DE)

( * ) Notice: Subject to any disclaimer, the term of this patent is extended or adjusted under 35 U.S.C. 154(b) by 0 days.

(21) Appl. No.: 09/806,799

(22) PCT Filed: Oct. 2, 1999

(86) PCT No.: PCT/DE99/03189

§ 371 (c)(1),
(2), (4) Date: Apr. 4, 2001

(87) PCT Pub. No.: WO00/22294

PCT Pub. Date: Apr. 20, 2000

(30) Foreign Application Priority Data

Oct. 9, 1998 (DE) ..... 198 46 616

(51) Int. Cl.[7] ..... F02M 37/04

(52) U.S. Cl. ..... 137/545; 137/549; 137/565.3; 137/575; 137/587; 137/590; 123/510; 123/514; 210/416.4

(58) Field of Search ..... 137/545, 549, 137/565.3, 575, 590, 587; 123/510, 514; 210/416.4

(56) References Cited

U.S. PATENT DOCUMENTS

| | | | | |
|---|---|---|---|---|
| 4,212,600 A | | 7/1980 | Otto et al. | |
| 4,306,844 A | | 12/1981 | Otto et al. | |
| 4,309,155 A | | 1/1982 | Heinz et al. | |
| 4,747,388 A | | 5/1988 | Tuckey | |
| 4,934,914 A | * | 6/1990 | Kobayashi et al. | 417/423.3 |
| 5,046,471 A | * | 9/1991 | Schmid | 123/509 |
| 5,111,844 A | * | 5/1992 | Emmert et al. | 137/567 |
| 5,218,942 A | | 6/1993 | Coha et al. | |
| 5,782,223 A | * | 7/1998 | Yamashita et al. | 123/510 |

FOREIGN PATENT DOCUMENTS

| | | |
|---|---|---|
| DE | 27 23 771 | 12/1978 |
| DE | 27 48 963 | 5/1979 |
| DE | 35 32 349 | 3/1986 |
| DE | 36 38 617 | 5/1988 |
| DE | 42 42 242 | 6/1994 |
| DE | 195 35 668 | 3/1996 |
| DE | 195 09 143 | 9/1996 |
| EP | 0 629 522 | 12/1994 |
| EP | 0 844 382 | 11/1997 |

* cited by examiner

*Primary Examiner*—A. Michael Chambers
(74) *Attorney, Agent, or Firm*—Collard & Roe. P.C.

(57) ABSTRACT

A device for an arrangement inside a fuel tank, provided with pumps and filters for supplying and filtering fuel that is fed to an internal combustion engine, whereby the fuel is conveyed from the bottom area of the tank through a first filter into a collector chamber and fuel is conveyed from said collector chamber by means of a second pump through a second filter to the internal combustion chamber. Both pumps are arranged in a pump unit. The collector chamber is arranged vertically above the pump unit and the filter with respect to the fitting position of the device and is embodied as an open overflow container, whereby the inventive device can be produced in a rational manner and offers good functionality.

7 Claims, 4 Drawing Sheets

DEVICE FOR AN ARRANGEMENT INSIDE A FUEL TANK FOR SUPPLYING AND FILTERING FUEL

The invention relates to a device for an arrangement inside a fuel tank, comprising pumps and filters for conveying and filtering fuel that is fed to an internal combustion engine, according to the precharacterising portion of claim 1.

Such a device known from EP 0 844 382 A2 is to be simplified and improved in relation to its design and function.

This object is met by a generic device with the characteristics of the claim.

Suitable and advantageous embodiments of the invention are provided in the subordinate claims.

A particularly simple and cost-effective design of, the device according to the invention is achieved in that, the filters including their inserts are firmly integrated in the housing parts and carrier parts, such that non-destructive exchange is not possible. The filters are thus to be designed as permanent filters, i.e. in principle, the service life of the filter is to be in line with the service life of the tank in which the device is inserted. If in a vehicle fuel tank with such a device, exchange of the filter becomes necessary, the entire housing complex and carrier complex of a generic device according to the invention has to be exchanged.

The drawing shows an embodiment according to the invention, said embodiment being explained in detail below.

The following are shown:

Figure 1:
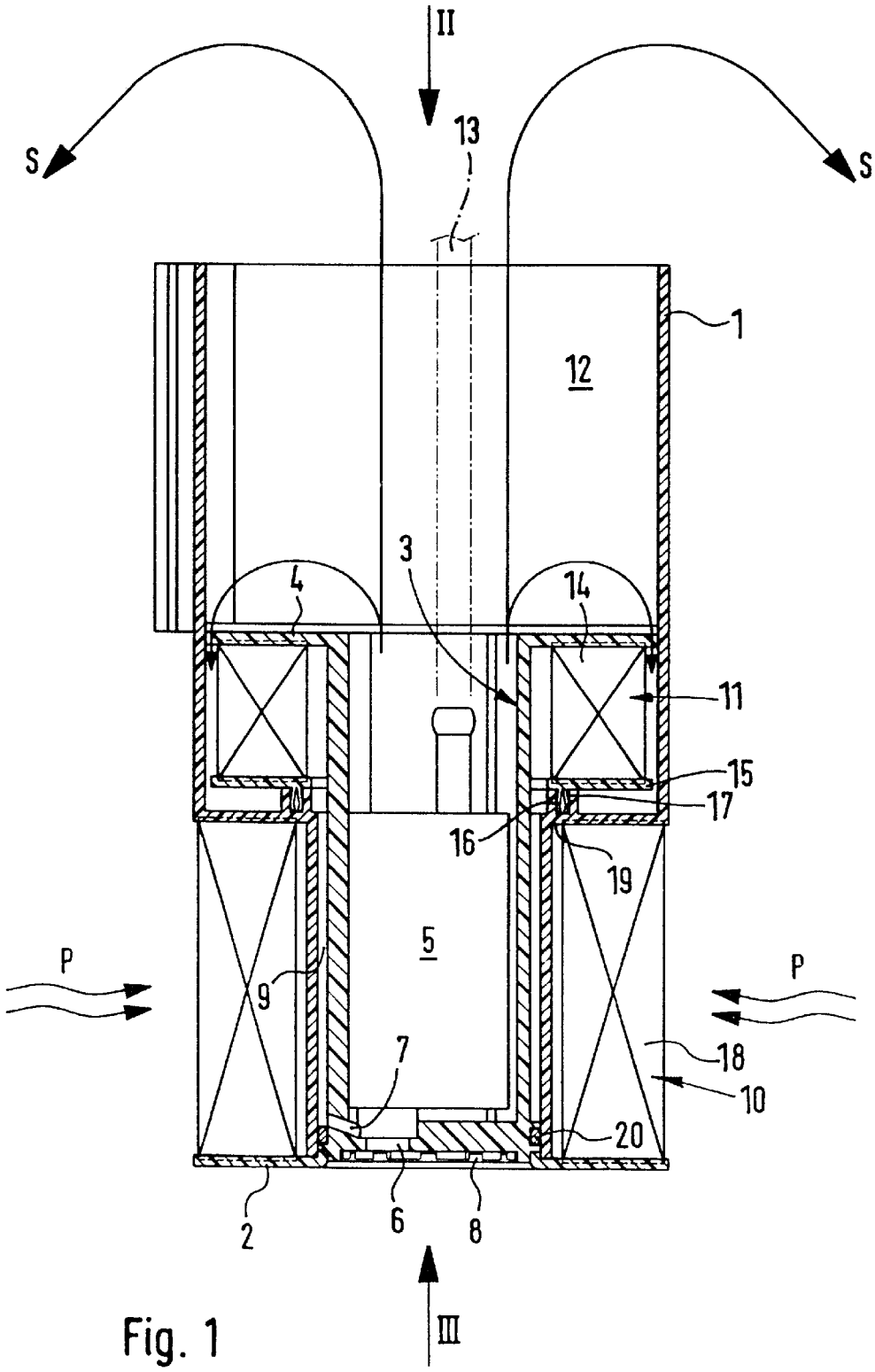
FIG. 1 shows a section through a filter-pump device for fuel, for arrangement inside a fuel tank.
Figure 2:
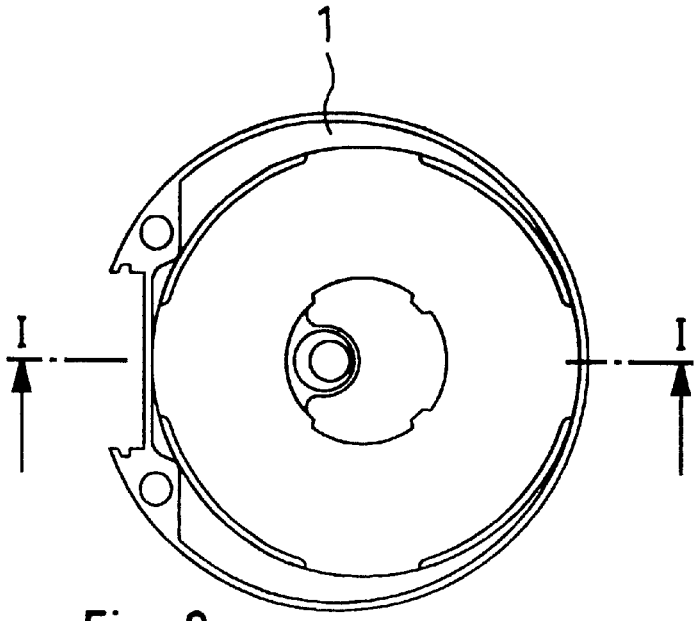
FIG. 2 is a top view of the device according to FIG. 1, in the direction of arrow II.
Figure 3:
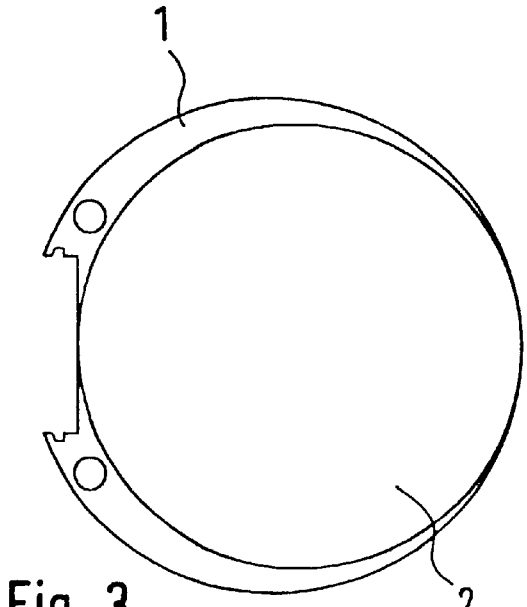
FIG. 3 is a view according to FIG. 1 from below, in the direction of arrow III.
Figure 4:
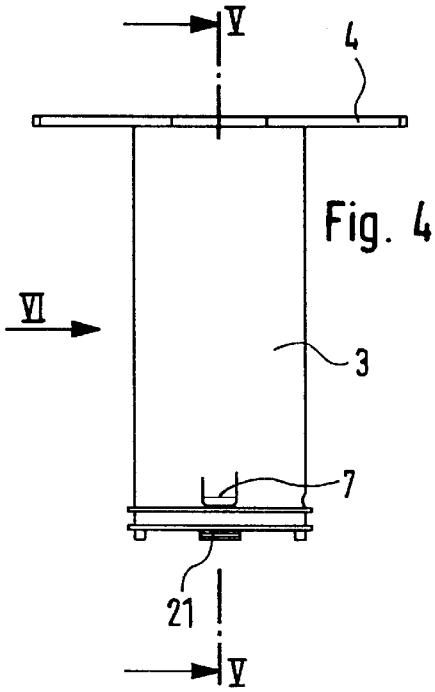
FIG. 4 is a view of a carrier part which can be inserted into the device according to FIG. 1.
Figure 8:
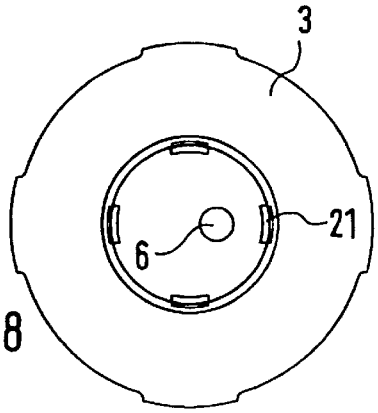
FIG. 8 is a view of the carrier part according to FIG. 6 from below in the direction of arrow VIII.
Figure 6:
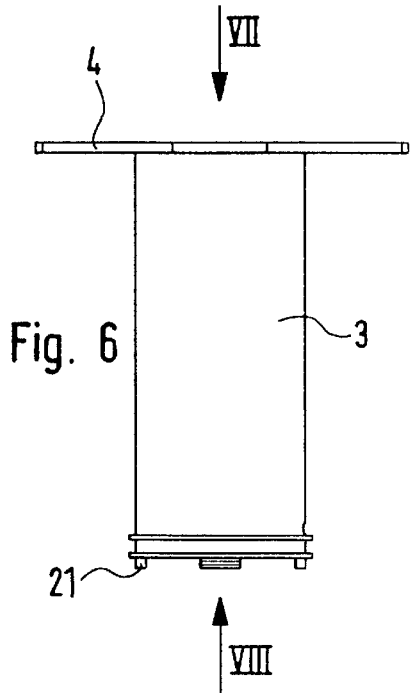
FIG. 6 is a view of the carrier part according to arrow VI in FIG. 4.
Figure 5:
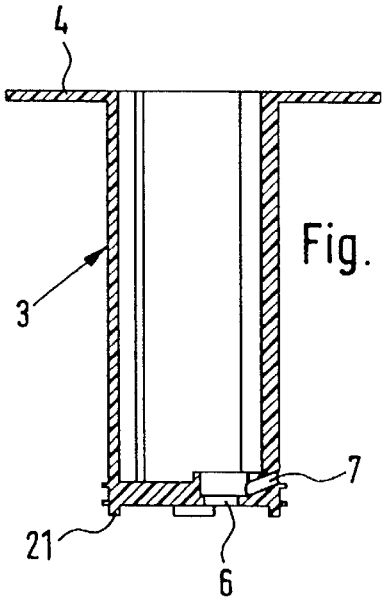
FIG. 5 shows a section through the carrier part along line V—V in FIG. 4.
Figure 7:
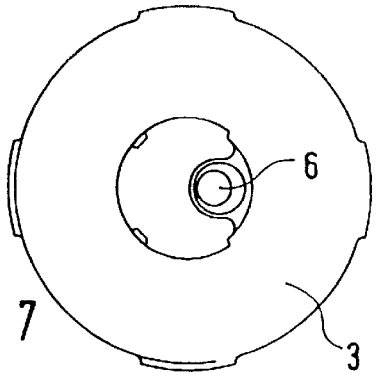
FIG. 7 is a view of the carrier part according to FIG. 6 from above in the direction of arrow VII.
Figure 9:
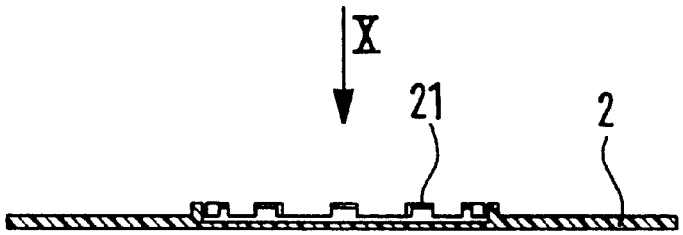
FIG. 9 shows a section through a bottom plate of the exterior housing of the device according to FIG. 1 along line IX—IX in FIG. 10, prior to attachment inside the device according to FIG. 1.
Figure 10:
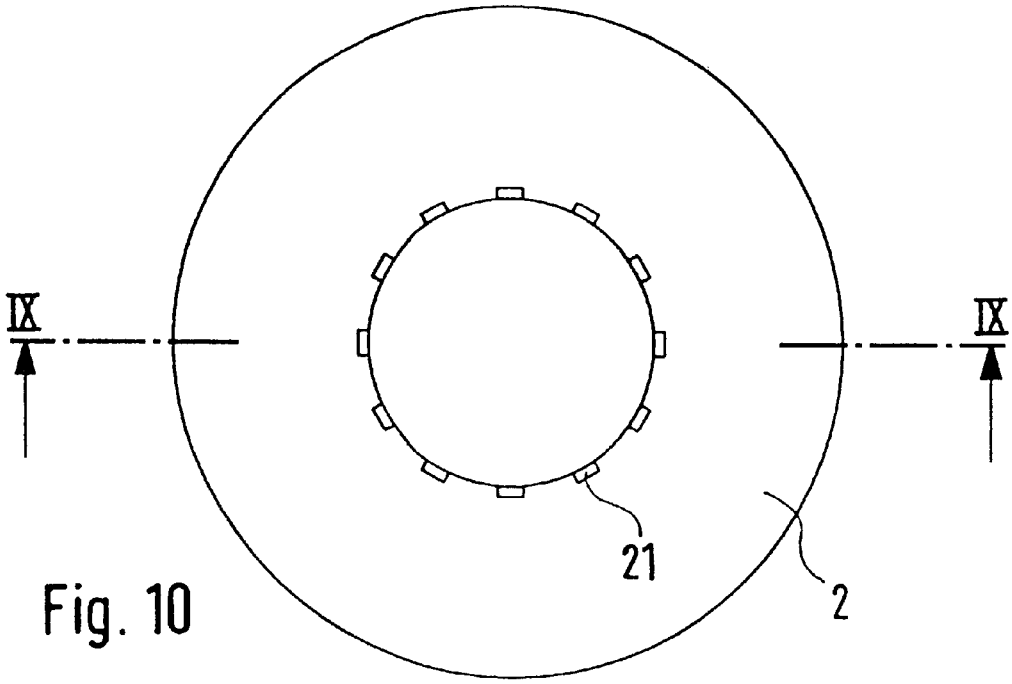
FIG. 10 is a view of the top plate according to FIG. 9 in the direction of arrow X.

A filter-pump device for arrangement inside a fuel tank, for example of a motor vehicle, comprises an exterior housing 1 in the shape of a bowl closed off at the bottom by a bottom plate 2. Closure of the bottom plate 2 on the exterior housing 1 will be explained in detail below.

A carrier part 3 which is also bowl-shaped comprising a ring flange 4 which at the open end juts radially outward, is inserted in the exterior housing 1. All the components described so far are preferably made of plastic. In the embodiment described, these components are indeed made of plastic.

A pump unit 5 comprising a first pump and a second pump is held in the carrier part 3. The first pump sucks fuel through an aperture 6 in the carrier part 3, while the second pump sucks fuel through an aperture 7 in the carrier part 3.

Outside the carrier part 3, the apertures 6 and 7 are connected to aspirating chambers 8 or 9 respectively.

By way of a first filter 10, the aspirating chamber 8 is connected to a region situated outside the exterior housing 1. In an arrangement of the exterior nousing 1 in a motor vehicle, this region is formed by the tank space.

By way of a second filter 11, the aspirating chamber 9 is connected to the upper interior region of the exterior housing 1, said interior region being configured as an overflow container 12. Fuel spilling over from the overflow container 12 enters the interior of the tank at an exterior housing 1 built into the tank.

Fuel conveyed by the first pump enters the overflow container 12. In the drawing in FIG. 1, the flow path of fuel conveyed in this way, is shown with flow arrows S.

Fuel conveyed by the second pump of the pump unit 5, is conveyed by way of a line 13 diagrammatically shown as a dot-dash line, to the injection nozzles of an internal combustion engine, for example of a motor vehicle.

The second filter 11 is designed as follows.

The insert of the second filter 11 is a ring filter element 14 made of a web material folded in a concertina shape. One face of this ring filter 14 is firmly and tightly connected to the ring flange 4 of the carrier part 3. The connection is established in that the ring filter element 14 is plasticised into the ring flange 4 made of plastic. The technique of such plasticising into place is known per se in the context of filters and is thus not explained here. On the opposite face, the ring filter element 14 is sealed off by means of a ring disk 15 which is also connected to the web material of the ring filter element 1 by way of plasticisation.

A sealing ring 16 is shaped to the ring disk 15 of the ring filter element 14, said sealing ring 16 engaging a ring groove 17 in the exterior housing 1 so as to form a seal.

The design of the first filter 10 is as follows.

The insert of this first filter 10 again is a ring filter element 18 comprising a folded web material, with one face of said ring filter element 18 being tightly plasticised into a circumferential step 19 of the exterior housing 1. The opposite face is tightly closed via a bottom plate 2, such closure also being achieved by way of a plasticised connection.

To ensure that the carrier part 3 is in an axially fixed position within the exterior housing 1, a catch connection with mutually engaging catch elements 20 is provided between the bottom of the carrier part 3 and the bottom plate 2.

In order to provide a tight design of the aspirating chamber 9, between the carrier part 3 and the exterior housing 1, at the location where these two parts join in the lower region of the entire device, a radial sealing ring 20 is provided in that location between said two parts.

The bottom plate 2 is connected to the carrier part 3 by way of engaging catch means 21, provided on said bottom plate 2. This connection anchors the carrier part 3 in the exterior housing 1 because the bottom plate 2 is firmly connected to this housing by means of the ring filter element 18.

The function of the filter pump device described above is as follows.

As indicated by arrows P, from the fuel tank, fuel is sucked in from the first pump of the pump unit 5 through the first filter 10 and conveyed to the overflow container 12.

From the overflow container 12 the second pump of the pump unit 5 sucks fuel through the second filter 11 and conveys this fuel at a specified pressure to the injection arrangement of an internal combustion engine.

The function of the first filter 10 consists in particular of filtering out, coarser dirt particles from the fuel before it reaches the first pump of the pump unit 5. Unlike the first filter 10, the second filter 11 is a fine-pore filter. The size of the filter surfaces of both filters 10 and 11 can be varied. For example the filter surface of the first filter can be approx, two thirds of the entire filter surface, and the filter surface of the second filter can be one third of the entire filter surface.

What is claimed is:

1. A device with a bowl-shaped exterior housing (1) for an arrangement inside a fuel tank, provided with pumps and filters (10, 11) for conveying and filtering fuel that is fed to an internal combustion engine, whereby the fuel is pumped from the bottom region of the tank with a first pump through a first filter (10) into a collector chamber and fuel is conveyed from said collector chamber by means of a second pump through a second filter (11) to the internal combustion engine, whereby the two pumps are arranged in a pump unit (5), whereby the collector chamber is arranged vertically above the pump unit (5) and the filters (10, 11) with respect to the fitting position of the device and is embodied as an open overflow container (12);

the second filter (11) is integrated in a carrier part (3) for the pump unit (5), said filter (11) being insertable in the lower region of the bowl-shaped exterior housing (1) and in this position is firmly connectable with said bowl-shaped exterior housing (1);

the upper region of the exterior housing (1) is configured as the the overflow container (12);

fuel present in the overflow container (12) can flow out of it through the second filter (11) into an aspirating chamber (9) of the second pump of the pump unit (5);

fuel present outside the exterior housing (1) of the tank can flow through the first filter (10) to an aspirating chamber (8) of the first pump of the pump unit (5);

characterised by the following features:

the filter inserts of both filters (10, 11) are arranged as a first and second ring filter element, one on top of the other, with the first filter (10) radially encompassing the lower region of the exterior housing (1), and the second filter (11) radially encompassing the upper region of the carrier part (3);

between an aspirating aperture of the second pump and an outlet aperture of the second filter (11) there is a closed aspirating chamber (9), closely delimited by the carrier part (3) and the exterior housing (1), with the aspirating aperture of the second pump being sealed off against a pass-through aperture (7) in the carrier part (3);

between an aspirating aperture of the first pump and an outlet aperture of the first filter (10) there is a closed aspirating chamber (8), closely delimited by the carrier part (3) and the exterior housing (1), with the aspirating aperture of the first pump being sealed off against a pass-through aperture (6) in the carrier part (3);

the pass-through apertures (6, 7) of the carrier part (3), said pass-through apertures (6, 7) being tightly connected to the aspirating apertures of the two pumps of the pump unit (5), are situated in the lower region of the exterior housing (1);

the carrier part (3) is bowl-shaped with a bottom, and a second filter (11) arranged in the upper exterior region, with the longitudinal region not covered by the second filter (11) being able to be slid into the exterior housing (1), with seals (16) and (20) being provided in the upper and lower region for a tight seat against the exterior housing (1).

2. A device according to claim 1, characterised in that the filters (10, 11) are arranged coaxially, one on top of the other.

3. A device according to claim 1, characterised in that the carrier part (3) in the lower region of the exterior housing (1) is non-positively engageable by a catch arrangement.

4. A device according to claim 1, characterised in that the ring filter elements (14 and 18) of the filters (10 or 11 respectively) are made of web material folded in a concertina shape which at least on one face is firmly and tightly connected to a region of the carrier part (3) or the exterior housing (1) respectively.

5. A device according to claim 4, characterised in that the ring filter element (14) of the second filter (11) comprises a cover at the face which is not directly connected to the carrier part (3), said cover being connected to the carrier part (3) only via said ring filter element (14), and with said cover being tightly connectable to the exterior housing (1).

6. A device according to claim 4, characterised in that the face of the first ring filter element (18), said face not being directly connected to the exterior housing (1), is firmly and tightly connected to a bottom plate (2), with the centre of this bottom plate (2) forming a joined bottom of the exterior housing (1).

7. A device according to claim 6, characterised in that, the bottom plate (2), as the bottom of the exterior housing (1), can engage the carrier part (3) by means of a catch arrangement.

* * * * *